7/13/82 OR 4,339,177

United States Patent [19]

March

[11] 4,339,177

[45] Jul. 13, 1982

[54] OPTICAL APPARATUS FOR CONTROLLING THE DISTRIBUTION OF ILLUMINATION

[75] Inventor: Adrian A. C. March, Swaineshill, England

[73] Assignee: Solartron Electronic Group Limited, Farnborough, England

[21] Appl. No.: 27,140

[22] Filed: Apr. 4, 1979

[30] Foreign Application Priority Data

Apr. 11, 1978 [GB] United Kingdom ..... 14062/78

[51] Int. Cl.[3] ..... G02B 13/20

[52] U.S. Cl. ..... 350/431; 350/448

[58] Field of Search ..... 350/188, 205, 431, 448

[56] References Cited

U.S. PATENT DOCUMENTS

| | | | |
|---|---|---|---|
| 1,562,757 | 11/1925 | Hammond | 350/448 |
| 2,185,221 | 1/1940 | Nakken | 350/205 X |
| 3,302,016 | 1/1967 | Larraburu | 350/188 X |
| 3,615,433 | 10/1971 | Biernson | 350/188 X |
| 3,752,561 | 8/1973 | Klemt | 350/96.1 |
| 3,843,235 | 10/1974 | Mino et al. | 350/448 |
| 4,168,512 | 9/1979 | Ito et al. | 350/448 |

*Primary Examiner*—John K. Corbin
*Assistant Examiner*—Scott J. Sugarman
*Attorney, Agent, or Firm*—Dale Gaudier

[57] ABSTRACT

In order to provide a laser beam having a relatively constant width (i.e. transverse spacing between points receiving a theshold irradiance), a converging lens 15 having substantial negative spherical aberration is used. In the far field, the beam comprises paraxial rays 18 which have diverged to provide the desired beam-width. In the near-field, the smaller, higher-irradiance beam formed by these rays is augmented by a 'sheath' of marginal rays 19 which are not refracted towards the optical axis as strongly as the paraxial rays. The shape of the beam in the far field is determined primarily by the shape of the (laser) light source 10, while that of the near-field beam is controlled by a mask 14. In another arrangement, a lens 102 having substantial positive spherical aberration is used to create a 'light source' having an accurately-controlled brightness distribution and very small size. Paraxial rays 109 are brought to a focus at a plane 108 defining the 'position' of the 'light source', while the more strongly refracted marginal rays 110 cross the optical axis before reaching this plane, thus creating a halo round the bright central beam produced by the paraxial rays. The brightness distribution at the plane is controlled by adjusting the spherical aberration of the lens, and by masking.

2 Claims, 10 Drawing Figures

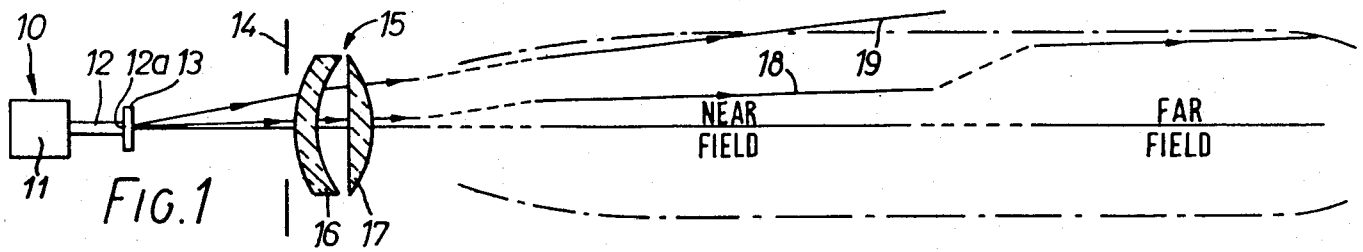
FIG. 1
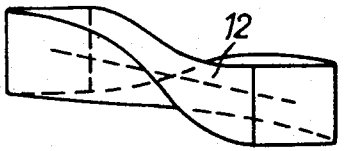
FIG. 2
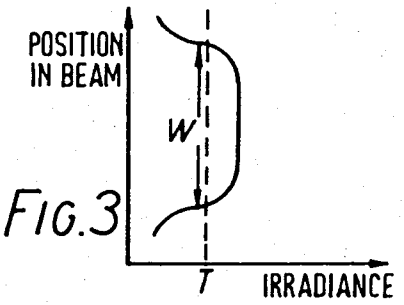
FIG. 3
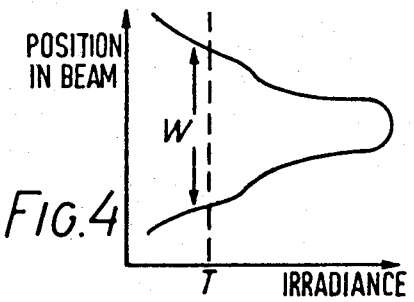
FIG. 4
FIG. 5
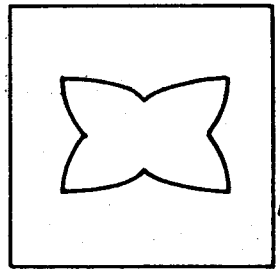
FIG. 6
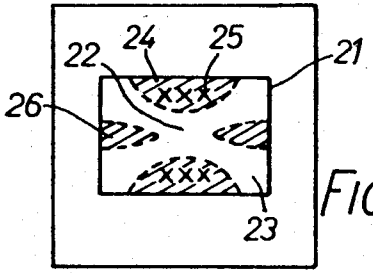
FIG. 7

OPTICAL APPARATUS FOR CONTROLLING THE DISTRIBUTION OF ILLUMINATION

This invention relates to optical apparatus, and particularly, though not exclusively, to optical apparatus for use in weapon effect simulators.

It is known to use a beam of electro magnetic radiation (typically from a laser) during simulated operation of a weapon for training purposes. In one type of system (UK Patent Specification Nos. 1 228 143, 1 228 144, 1 439 612 and 1 451 192), the beam of radiation is pointed in the same direction as the weapon (for example, a gun) at the time of 'firing' the ammunition (a shell) with adjustment for such factors as aim-off if appropriate. In another type (UK Patent Specifications Nos. 1 300 941, 1 300 942) the beam is pointed to intersect continuously the path that the ammunition (for example, a missile) would follow in a live firing. In either case, the result is that the beam of radiation is directed at the point in space occupied by the ammunition when it reaches the vicinity of the target.

It is also known, in the first type of system mentioned above, to scan the beam in azimuth and elevation to derive information regarding the type of error (high, low, left, right) in the event of a miss.

One requirement of these systems is that, ideally, the beam should have a 'width' which is generally independent of distance, or at least not proportional to distance, (for example, varying by a factor of about 2 or less for a maximum range 8 times the minimum range). 'Width' in this case means the spacing transversely of the beam of two points at which the irradiance (that is, density of energy in the beam) has some predetermined threshold value, the irradiance being at or above this value in between these points and below this value outside them. Uniform width is desirable for the beam to represent the (constant) dimensions of the kill-zone of the ammunition irrespective of range.

It is an object of this invention to provide optical apparatus which supplies a beam of radiation having a width which is less dependent on distance than is the case with beams provided by known apparatus.

According to one aspect of this invention there is provided optical apparatus comprising a lens or lens system in which at least one functional element group has predetermined non-zero spherical aberration, a source of visible or near-visible radiation having predetermined size and shape and arranged to provide a predetermined distribution of illumination, and means to control the spatial distribution of transmission of rays through at least one transverse plane in the apparatus.

The spherical aberration involved is significant; the or each said functional element group is not adjusted for minimum spherical aberration, nor solely to compensate for spherical aberration elsewhere in the apparatus.

The source of radiation may comprise a laser or laser stack (for example of the gallium arsenide type), and may include means for providing said predetermined distribution of illumination. This means may comprise light integrating means and diffusing means, in which case said integrating means and diffusing means can also serve to determine said size and shape. Alternatively said size and shape may be determined by the geometry of the laser or stack, either alone or in conjunction with a mask.

The control means may comprise a mask, for example an apertured mask or a variable-density mask.

It has been found that by appropriate choice of the magnitude and sign of the spherical aberration of the functional element group or groups, and by appropriate selection of the control means, it is possible to manipulate the irradiance distribution of a beam of radiation produced by the apparatus in a variety of ways. For example, it is possible to provide, from a lens having simple circular symmetry, a beam having non-circular symmetry, such as a beam of approximately rectangular cross-section and comparatively uniform width.

According to another aspect of this invention there is provided optical apparatus comprising a source of visible or near-visible radiation, means arranged to determine the effective size and shape of the source and to provide a predetermined distribution of illumination, means to control the spatial distribution of ray transmission through at least one transverse plane in the apparatus, and a functional lens-element group in which a first element has moderate negative power and non-minimum negative spherical aberration and a second element has positive power of larger absolute magnitude than said negative power and (substantially minimum) positive spherical aberration of smaller absolute magnitude than said negative spherical aberration.

According to a further aspect of this invention there is provided optical apparatus comprising a source of visible or near-visible radiation, means arranged to determine the effective size and shape of the source and to provide a predetermined distribution of illumination, means to control the spatial distribution of ray transmission through at least one transverse plane in the apparatus, a first functional lens-element group having overall positive spherical aberration and positive power and a second functional lens-element group also having overall positive spherical aberration and positive power. This apparatus may be used in combination with an object glass having minimum aberration.

Two forms of optical apparatus in accordance with this invention for use in weapon effect simulators will now be described, by way of example, with reference to the accompanying drawings, in which:

FIG. 1 is a ray diagram (not to scale) of a first form of the apparatus;

FIG. 2 shows a light integrator, in the apparatus of FIG. 1;

FIG. 3 shows the irradiance distribution in the far field of the beam produced by the apparatus of FIG. 1;

FIG. 4 shows the irradiance distribution in the near field of the beam;

FIGS. 5, 6 and 7 show three forms of a mask in the apparatus of FIG. 1;

Figure 8:
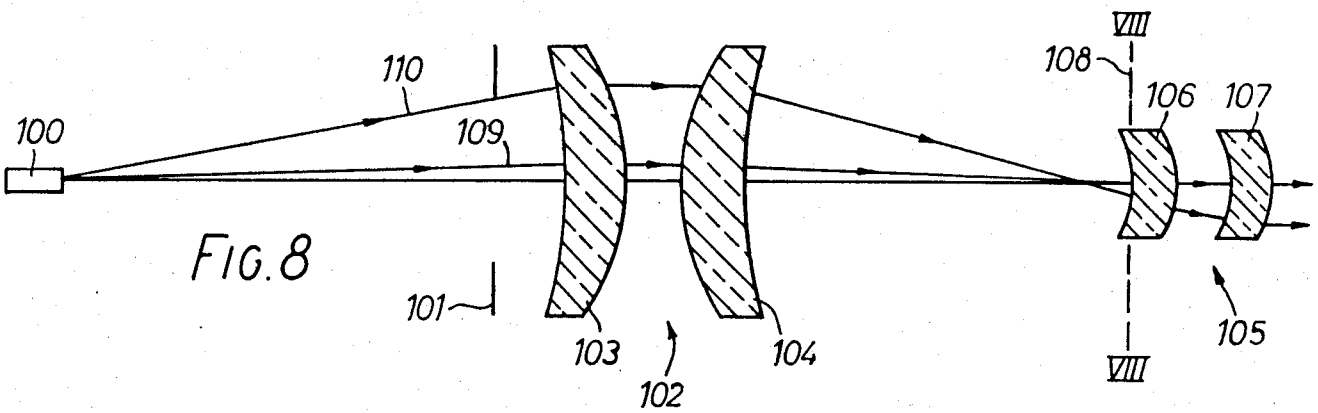
FIG. 8 is a ray diagram (not to scale) of the second form of the apparatus.

The optical apparatus to be described is intended to provide a laser beam for use in a weapon effect simulator. The useful range of the simulator is typically several hundred meters to several kilometers. The beam is used to represent ammunition during training of, for example, a crew manning a tank or an infantryman using a hand-launched missile. The target is equipped with photo-detectors to sense and indicate incidence of the beam of the target. The precise way in which the beam is used, for example to provide hit and near-miss indications with shellfire or to simulate flight of a missile, is described in detail in the patent specifications mentioned earlier.

It is desirable that the beam should be approximately rectangular in cross-section, of the order of a few meters in each dimension, and that these dimensions should not vary a great deal between the minimum and maximum ranges. It is noted that a simple collimator to produce such a beam would require a lens a few meters in diameter; whereas with a lens arranged to produce a beam which simply diverged to the desired width at, say, maximum range, the width at closer ranges would be much too small.

Referring to FIG. 1, the first apparatus according to this invention includes a light source 10 having a laser 11, a light integrator 12 and a diffuser 13. The laser 11 contains several gallium arsenide junction-diode laser devices, with optical fibres extending from the light-emitting sections of the devices to an area of rectangular shape on one end of the integrator 12. The integrator 12 acts to mix the light rays emerging from the individual optical fibres, by total internal reflection within itself. The integrator 12 is made from a thin, short rod of glass of square or rectangular cross-section, and its ends are twisted with respect to one another by about 90° about its axis, as illustrated in FIG. 2. The beam from a gallium arsenide laser itself is substantially fan-shaped, and encloses a large angle in one plane but a small angle in the orthogonal plane, and the twisting of the integrator 12 has the effect of reducing this asymmetry in the angular dipersion of the emerging laser radiation.

The light emerges from the other end 12*a* of the integrator 12, which end is rectangular and typically 0.1 mm by 0.16 mm in cross-section, and passes through the diffuser 13. This diffuser 13 is made of shot-blasted perspex and is included to ensure that the end-face 12*a* is the only part of the light-source 10 which can be imaged by the lenses in the optical apparatus. Without the diffuser 13, it is possible for unwanted images to appear of points in the plane of the end of the integrator 12 adjacent the laser 11, owing to reflection within the integrator 12 (a kind of hall-of-mirrors effect), thereby producing hot-spots (points of high intensity) in the beam from the apparatus.

The light emitted from the diffuser 12 passes through a mask 14 (to be described in more detail hereinafter) in front of a compound lens 15.

The compound lens 15 has two elements, a concave meniscus (diverging) element 16 followed by a plano-convex (converging) element 17. The curvatures of the element 17 are chosen to provide a large (positive) power (measured in dioptres) and a near- minimum (positive) spherical aberration. The curvatures of the element 16, on the other hand, are chosen to provide a medium (negative) power and a relatively large (negative) spherical aberration. In consequence, the elements 16 and 17 form a functional group having overall, a medium value (positive, convergent) power, but a negative spherical aberration which is not minimized in value. This is contrary to orthodox optical practice, in which lens elements are chosen to eliminate or at least minimise spherical aberration, in so far as this consistent with minimizing other aberrations.

As a result, and as shown by two typical rays in FIG. 1, a ray 18 which emerges from the centre of the diffuser 13 at a small angle to the optical axis passes through the centre portion of the compound lens and is refracted so as to continue at a smaller angle (virtually parallel) to the axis. However, a ray 19 at a larger angle to the axis, which in a normal convergent lens would be refracted parallel to the axis, is in this case refracted towards the axis to a lesser extent, so that it continues on a significantly divergent path. The effect of this is that in the far field the beam is composed solely of the rays 18 that are radiated from the diffuser 13 at small angles to the optical axis. The width w (and height) of the beam at maximum range (that is, the distance measured across the beam over which the irradiance exceeds some threshold value T - see FIG. 3) is controlled predominantly by the width (and height) of the end-face 12*a* and the power of the compound lens 15.

In the near field, at the lower end of the range, the rays 18 produce a narrower, more intense beam, as illustrated by FIG. 4. However, the irradiance remains higher than T across the desired width w, because the more divergent rays 19 provide additional radiant energy, around the rays 18 in the near field. As shown in FIG. 4, the irradiance of the beam in the near field is substantially higher than T in the centre of the beam. However, this is unimportant. It is only necessary that the irradiance should not fall below T across the desired width w.

As noted above, the width and height of the beam in the far field are related to the shape of the end-face 12*a*, because the central rays 18 produce an approximate image of the end-face 12*a*. However, in the near field, the marginal rays 19 also contribute to the beam, as explained above and shown in FIG. 1. These marginal rays are controlled by the circularly symmetrical spherical aberration of the lens 15, and hence would tend to produce a beam of circular cross-section. To avoid this the mask 14 is included to impose the desired approximately rectangular shape on the beam produced by the marginal rays 19.

In the simplest case, the mask 14 can be a plate having a rectangular aperture 20, FIG. 5. However, it is possible to use more complex shapes, incorporating cusps for example, as shown in FIG. 6, to produce a more nearly rectangular beam in the near field.

Even closer control of beam shape can be obtained by using variable-density masks, in which the attenuation of the light in each small region can have values in between full transmission and zero transmission. One possible pattern for a variable-density mask for use as the mask 14 is shown in FIG. 7. This could be a glass plate carrying a photographic emulsion having the desired density at each point. Referring to FIG. 7, the light-transmissive area 21 of the mask has a centre clear portion 22 and four clear arms 23 which correspond to the required corners of the radiated beam. At the top and bottom there is an arcuate area 24 of low density at its edges increasing to a high density near its centre 25. At each side there is a long, narrow area 26, again of high density.

A variable-density mask can be made by photographic techniques, for example, from a master made by a computer-controlled plotter printing dots of different sizes and spacings in an appropriate pattern. Alternatively, a section having the shape of an area of one density can be cut from a sheet of pre-printed dots having a uniform size and spacing appropriate to the density, and placed next to other sections cut from sheets of dots having the required densities for the adjacent regions, to make up the required master.

The effect of the mask 14 is to control the spatial distribution of transmission of the light rays through the plane of the mask 14. In the case of an aperture mask (FIGS. 5 and 6), the possible values of transmission are two: full transmission and zero transmission. In the case of the variable-density mask, intermediate values are also possible, as noted earlier.

The choice of mask and its shape, and of the spherical aberration values of the lens 15, will depend on individual circumstances, and is within the ability of one skilled in the art.

Referring now to FIG. 8, there is shown a second optical apparatus which is to be used in conjunction with a well-corrected object glass (not shown) having low aberrations to produce a relatively constant-width beam of radiation.

The apparatus includes a light source 100, which may be similar to the light source 10 in FIG. 1, the light from which passes through an aperture mask 101 having a rectangular opening, to a first functional group 102 of two converging elements 103 and 104. The curvatures of these elements 103 and 104 are chosen to provide the group 102 with moderate positive spherical aberration in addition to positive power. Light emerging from the second element 104 passes to another functional group 105 comprising two field lenses 106 and 107. This group also has significant positive spherical aberration, and the element 106 has its face adjacent the group 102 in the vicinity of the focal plane 108 of the object glass.

Figure 9:
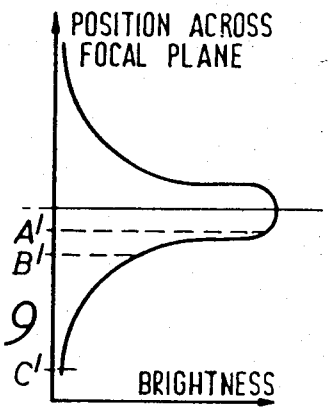
FIG. 9 shows the brightness distribution of light at the plane VIII—VIII in FIG. 8.

Light rays, such as 109, emerging from a given point of the light source 100 at a small angle to the optical axis are focussed by the group 102 at the focal plane 108. However, light rays such as 110 emerging from the same point at larger angles to the axis are converged more strongly, owing to the positive spherical aberration of the group 102, and focussed in a plane between the groups 102 and 105; in other words, not focussed at the focal plane 108. As a result, the brightness distribution on the focal plane 108 from one side of the optical axis to the other is as shown in FIG. 9: a very bright central zone, which is in effect a focussed image of the laser 100, surrounded by a diffuse halo caused by the outer, more strongly refracted rays 110.

As can be seen in FIG. 8, the marginal rays 110 reach the focal plane 108 at a considerable angle to the optical axis, and the purpose of the field lenses 106 and 107 is to refract these rays sufficiently for them to reach the object glass. The positive spherical aberration of the group 105 is selected to facilitate this, by providing a field lens which has an effective power increasing with distance from the axis.

Figure 10:
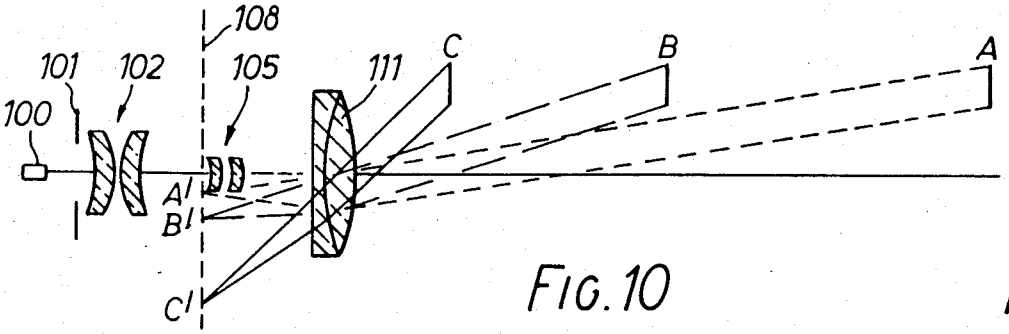
FIG. 10 is a ray diagram (not to scale) showing the apparatus of FIG. 8 in use.

The complete system incorporating the second apparatus is shown schematically in FIG. 10—it should be noted that this figure only shows the relative disposition of the component parts, and is not to scale. In particular the rays shown emanating from the focal plane 108 would in practice emerge from the group 105, but their spacing has been greatly enlarged in FIG. 10 for clarity. The object glass is indicated at 111, and A, B and C represent detectors at the same distance off the optical axis at ranges of 6, 3 and 1 km respectively. It is well known that light rays from a single point in the focal plane of a well-corrected lens (111) emerge from the lens substantially parallel to one another. Thus, since the detector at A effectively only receives parallel rays from the lens 111, it only receives rays from the point A' in the focal plane 108. Similarly, the detectors at B and C only receive rays from the points B' and C'. The curvatures of the elements 103 and 104 are chosen to give a brightness distribution (FIG. 9) such that the brightnesses at B' and C' are ¼ and 1/36 respectively of the brightness at A' (in practice these fractions would have to be decreased from these theoretical values to compensate for the greater atmospheric absorption at long range). Thus, the irradiances at A, B and C are the same. If the irradiance at C is the threshold value defining the edge of the near-field beam (controlled, in part, by the dimensions of the mask 101) then the detectors A and B (at the same spacing from the optical axis) are likewise at the edge of the beam. Thus the width of the beam (the distance across the optical axis between points receiving the threshold irradiance) is relatively constant with the range.

As with the optical apparatus of FIG. 1, the irradiance on the optical axis will exceed the threshold value, particularly at the range of C, but this is of little significance in producing a beam of controlled width, in which the irradiance at the beam edge is the important parameter.

The integrator 12 and the diffuser 13 may in some cases be omitted, in which case the size, shape of and distribution of illumination from the light source can be determined either by the configuration of the laser(s), or by means of a mask immediately in front of the laser.

I claim:

1. Optical apparatus comprising a source of visible or near-visible radiation, means arranged to determine the effective size and shape of the source and to provide a predetermined distribution of illumination, means to control the spatial distribution of ray transmission through at least one transverse plane in the apparatus, and a functional lens-element group in which a first element has moderate negative power and non-minimum negative spherical aberration and a second element has positive power of larger absolute magnitude than said negative power and positive spherical aberration of smaller absolute magnitude than said negative spherical aberration.

2. Optical apparatus comprising a source of visible or near-visible radiation, means arranged to determine the effective size and shape of the source and to provide a predetermined distribution of illumination, means to control the spatial distribution of ray transmission through at least one transverse plane in the apparatus, a first functional lens-element group having overall positive spherical aberration and positive power and a second functional lens-element group also having overall positive spherical aberration and positive power.

* * * * *